US009797388B2

(12) United States Patent
Biesek et al.

(10) Patent No.: US 9,797,388 B2
(45) Date of Patent: Oct. 24, 2017

(54) ADAPTING DEVICE FOR LINEAR COMPRESSOR, AND COMPRESSOR PROVIDED WITH SUCH DEVICE

(75) Inventors: Fernando Luiz Biesek, Joinville (BR); Everton Magnabosco, Joinville (BR)

(73) Assignee: Whirlpool S.A., Sao Paulo, Sp (BR)

( * ) Notice: Subject to any disclaimer, the term of this patent is extended or adjusted under 35 U.S.C. 154(b) by 246 days.

(21) Appl. No.: 14/130,110

(22) PCT Filed: Jun. 21, 2012

(86) PCT No.: PCT/BR2012/000206

§ 371 (c)(1),
(2), (4) Date: Mar. 11, 2014

(87) PCT Pub. No.: WO2013/003921

PCT Pub. Date: Jan. 10, 2013

(65) Prior Publication Data

US 2014/0193278 A1 Jul. 10, 2014

(30) Foreign Application Priority Data

Jul. 4, 2011 (BR) ..... 1103355

(51) Int. Cl.

| | |
|---|---|
| ***F04B 17/04*** | (2006.01) |
| ***F04B 35/04*** | (2006.01) |
| ***F04B 39/12*** | (2006.01) |

(52) U.S. Cl.

CPC ..... *F04B 17/04* (2013.01); *F04B 35/045* (2013.01); *F04B 39/127* (2013.01)

(58) Field of Classification Search

CPC .... F04B 39/127; F04B 35/045; F04B 17/044; F04B 17/042; F04B 17/048; F04B 17/04; F15B 15/1476

(Continued)

(56) References Cited

U.S. PATENT DOCUMENTS 3,171,585 A * 3/1965 Gauss ..... F04B 35/045 417/417
3,325,085 A * 6/1967 Gaus ..... F04B 35/045 417/416

(Continued)

FOREIGN PATENT DOCUMENTS

BR P10601645 A 12/2007
EP 1 635 442 A1 3/2006

(Continued)

OTHER PUBLICATIONS

International Search Report for PCT/BR2012/000206 dated Oct. 25, 2012.

*Primary Examiner* — Bryan Lettman
(74) *Attorney, Agent, or Firm* — Harrington & Smith

(57) ABSTRACT

An apparatus for connecting a resilient member 1 to a magnetic actuator 2 of a linear compressor. The apparatus includes at least one support member 6 cooperating with a resilient element 1, the support member 6 includes a substantially cylindrical part equipped with intermediate perimeter salient portion 61; at least one fastening element 7 cooperating with the support member 8 and the magnetic actuator 2, and enabling interconnection between a magnetic actuator 2 and a resilient member 1 of a detachable and electrically insulated linear compressor, the fastening element 7 being made in electrically insulating and non-magnetic material.

5 Claims, 3 Drawing Sheets

(58) Field of Classification Search
USPC ..... 417/416, 417
See application file for complete search history.

(56) References Cited

U.S. PATENT DOCUMENTS 3,462,136 A * 8/1969 Rollin ..... F16F 1/326 188/268
3,786,834 A * 1/1974 Garland ..... F16K 15/08 137/512.1
3,814,550 A * 6/1974 Adams ..... H02K 33/18 417/417
4,044,628 A * 8/1977 Jacks ..... F16F 15/1213 188/268
5,146,124 A * 9/1992 Higham ..... F16F 7/116 310/17
5,980,211 A * 11/1999 Tojo ..... F04B 49/065 417/45
6,015,273 A * 1/2000 Hannagan ..... F04B 35/045 417/417
6,565,333 B2 * 5/2003 Maruyama ..... F04B 17/003 417/206
6,742,998 B2 * 6/2004 Kawahara ..... F04B 35/045 417/363
6,884,044 B2 * 4/2005 Lilie ..... F04B 35/045 417/363
7,163,384 B2 * 1/2007 Lilie ..... F04B 35/045 267/179
D658,681 S * 5/2012 Takemori ..... D15/7
D658,682 S * 5/2012 Takemori ..... D15/9
D658,683 S * 5/2012 Takemori ..... D15/9
8,998,589 B2 * 4/2015 Lilie ..... F04B 35/045 417/410.1
2002/0164255 A1 * 11/2002 Burr ..... F04B 45/047 417/363
2003/0017064 A1 * 1/2003 Kawahara ..... F04B 35/045 417/417
2004/0001768 A1 * 1/2004 Fujisawa ..... F04B 35/045 417/416
2004/0074700 A1 * 4/2004 Lilie ..... F04B 35/045 184/6.16
2004/0115076 A1 * 6/2004 Lilie ..... F04B 35/045 417/416
2004/0145247 A1 * 7/2004 Lilie ..... H02K 33/02 310/156.01
2005/0123422 A1 * 6/2005 Lilie ..... F04B 35/045 417/416
2005/0260086 A1 * 11/2005 Park ..... F04B 35/045 417/417
2006/0034710 A1 * 2/2006 Moretti ..... F04B 35/045 417/417
2006/0034712 A1 * 2/2006 Park ..... F04B 35/045 417/417
2006/0220473 A1 * 10/2006 Ueda ..... H02K 33/16 310/12.25
2007/0041855 A1 * 2/2007 Hansen ..... F04B 35/045 417/417
2007/0041856 A1 * 2/2007 Hansen ..... F04B 49/14 417/417
2007/0110600 A1 * 5/2007 Park ..... F04B 35/045 417/417
2008/0008607 A1 * 1/2008 Schade ..... F04B 35/045 417/410.1
2008/0075610 A1 * 3/2008 Bonniface ..... F04B 35/045 417/417
2008/0089796 A1 * 4/2008 Schade ..... F04B 35/045 417/417
2008/0112829 A1 * 5/2008 Hell ..... F04B 35/045 417/546
2008/0134833 A1 * 6/2008 Lilie ..... F04B 35/045 74/581
2008/0267798 A1 * 10/2008 Liu ..... F04B 35/045 417/416
2009/0081049 A1 * 3/2009 Tian ..... F04B 35/045 417/18
2009/0081058 A1 * 3/2009 Ishibashi ..... F04B 35/045 417/417
2009/0202373 A1 * 8/2009 Williams ..... F04B 35/045 417/437
2009/0280015 A1 * 11/2009 Lillie ..... F04B 35/045 417/416
2010/0296951 A1 * 11/2010 Lee ..... F04B 35/045 417/417
2010/0310393 A1 * 12/2010 Lee ..... H02K 33/16 417/417
2013/0121855 A1 * 5/2013 Lilie ..... F04B 35/045 417/363
2014/0007765 A1 * 1/2014 Takemori ..... F04B 35/045 92/137
2014/0234137 A1 * 8/2014 Roman ..... F04B 35/045 417/363
2014/0234145 A1 * 8/2014 Roman ..... F04B 35/045 417/481
2014/0241911 A1 * 8/2014 Roman ..... F04B 35/045 417/328
2014/0301874 A1 * 10/2014 Roettger ..... F04B 35/045 417/437
2014/0340003 A1 * 11/2014 Silvia ..... F04B 35/045 318/128
2015/0040752 A1 * 2/2015 Roman ..... F04B 39/0022 92/172
2015/0219095 A1 * 8/2015 Muhle ..... F04B 39/0292 92/169.1

FOREIGN PATENT DOCUMENTS

WO 2006069883 A1 7/2006
WO 2011003163 A1 1/2011
WO WO2011003163 * 1/2011

* cited by examiner

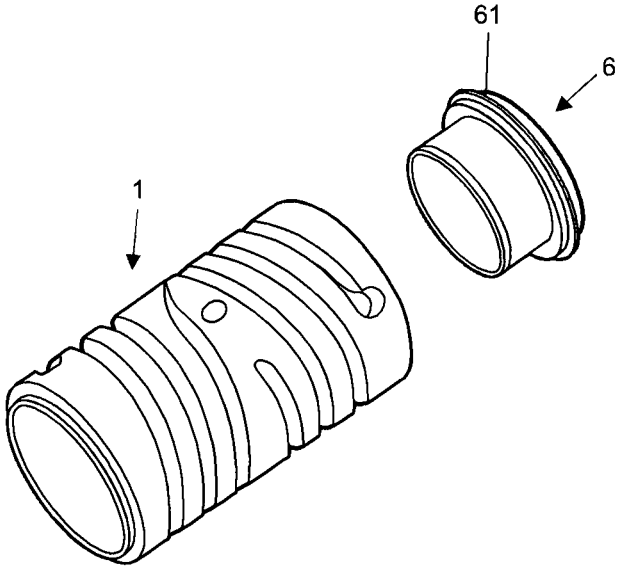
FIG. 5.1
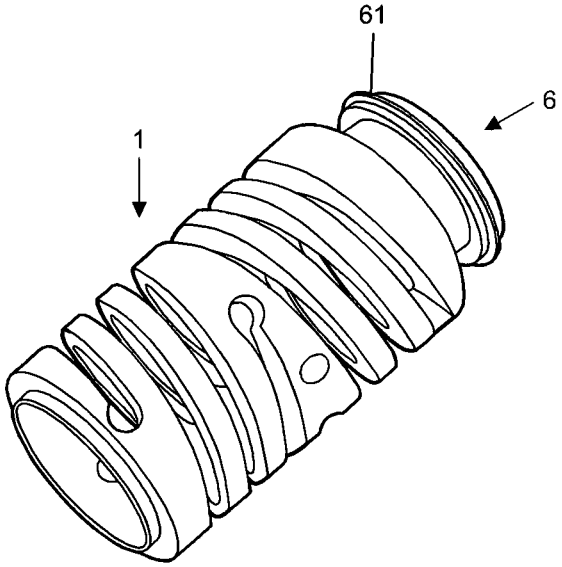
FIG. 5.2

ADAPTING DEVICE FOR LINEAR COMPRESSOR, AND COMPRESSOR PROVIDED WITH SUCH DEVICE

RELATED APPLICATIONS

The subject application is a U.S. National Stage Application of International Application No. PCT/BR2012/000206, filed on 21 Jun. 2012, which claims the priority of Brazil Patent Application No.: PI1103355-0, filed on 4 Jul. 2011, the contents of which are herein incorporated by reference in its entirety.

FIELD OF THE INVENTION

The present invention relates to an adapter device for compressors, more specifically designed to attach the magnetic ring to the resonant spring of a linear compressor, which may or may not allow the simultaneous accommodation of such parts, of a spring or a flat leaf spring.

BACKGROUND OF THE INVENTION

As it is known in the art, the linear compressor equipment is provided with a piston axially movable within a compression chamber in order to raise the pressure of a given volume of fluid to a value necessary for the proper operation of a system—which generally, it a cooling system. Therefore, such compressors comprise a housing, a cylinder attached to the housing defining a compression chamber, a piston, a linear electric motor, and actuator means coupling the motor to the piston via a resilient means which usually constitutes a resonant spring.

It happens, however, that the electric actuator—which is usually constituted by a magnetic body—is typically coupled rigidly (gluing, welding, etc.) to the resilient element, which makes difficult possible part maintenance and replacement procedures. Moreover, the resilient element (or resonant spring), for being metallic, may possibly impair the proper magnetic flux of the actuator causing unwanted losses and, in addition, a disruption of the magnetic body during operation of the compressor can permit the passage of electric current from the motor to the resilient element, causing many troubles.

Document PI0601645-BR 6 can be recited as an example of the current state of the art that besides illustrating the embodiment above mentioned, and still discloses the presence of a base portion for interconnecting with the resilient member, which requires the use of large amount of material for its manufacture and, consequently, an increase in involved manufacturing costs.

It is also recited that such rigid coupling makes it difficult any maintenance procedures and interfere with the proper movement/action of the elastic medium.

It should also be noticed that many compressors operating with flat springs, or combinations of flat springs arranged at the ends of the resilient medium to act as fastening elements for fastening the assembly to the compressor housing—elements that also absorb working stresses and, therefore, are critically important for the proper operation and minimization of the level of noise emitted during operation of the compressor. Thus, the rigid coupling between the resilient element and the actuator means also complicates the installation and positioning of flat springs—which often also become rigidly attached to both parts, incurring the same drawbacks mentioned above.

OBJECTS OF THE INVENTION

Therefore, it is one of the objects of the present invention an appropriate means—and electrically insulated—for the coupling between the resilient member of a compressor and its linear magnetic actuator.

Another among the objects of the present invention is to provide an adapter capable of interconnecting the magnetic actuator and the resonant spring by interference—and not so rigidly as it happens to the similar known ones.

It is a further object of the present invention to disclose an adapter for resonant springs whose coupling form between the parts allows a significant reduction in the dimensions of the same—in particular, the magnetic actuator—resulting in a more compact equipment, and possibly more economical one.

SUMMARY OF THE INVENTION

The present invention achieves the above objects through an adapter device for linear compressor comprising a resilient member, a magnetic actuator and a reciprocating piston coupled to the resilient member by means of a rod or connecting rod, the compressor being capable of operating using flat springs, said adapter device comprising: at least one support member cooperating with a resilient element, said support member comprising a substantially cylindrical part equipped with intermediate perimeter salient portion, and at least one fastening ring cooperating with the support member and the magnetic actuator.

Briefly, the adapter device for linear compressor object of the present invention comprises means for enabling interconnection between a magnetic actuator and a resilient member—or resonant spring—of a linear compressor in a detachable, electrical and magnetically isolated manner.

According to a preferred embodiment of the present invention, the fastening element is made of electrically insulating and non-magnetic material—preferably of ceramic.

Also according to a preferred embodiment of the present invention, the support member couples to the resilient member by interference coupling, more specifically by male type fitting, preferably in such a manner that the support member couples to the distal inner region of the perimeter resilient member.

In one of the possible embodiments of the present invention, the distal edge of the fastening ring is coated with an adhesive element to allow any attachment to the magnetic actuator, and preferably the distal edge of fastening ring has splitter elements for ensuring that the adhesive layer keeps constant.

The support member of the adapter object of the present invention is also provided with a perimeter intermediate salient portion that sets a stop for the coupling, by fitting, of at least one flat spring between said perimeter salient portion and the distal end of the intermediate resilient member.

The present invention further comprises a linear compressor comprising a resilient member, a magnetic actuator and a reciprocating piston coupled to the resilient member by means of a rod or connecting rod, the compressor being capable of operating using flat springs, characterized in that it comprises an adapter device defined by at least one support member cooperating with the resilient member, said support member comprising a substantially cylindrical part equipped with intermediate perimeter salient portion; and at least one fastening ring cooperating with the support member and the magnetic actuator, said fastening ring being produced from an electric and non-magnetic insulating material.

BRIEF DESCRIPTION OF THE DRAWINGS

The figures show:

FIG. 5.1—shows an exploded perspective view of the resilient member and the adapter, taken separately;

FIG. 5.2—shows a perspective view of the adapter object of the present invention suitably coupled to the resilient element of a linear compressor.

DETAILED DESCRIPTION OF THE INVENTION

Figure 1:
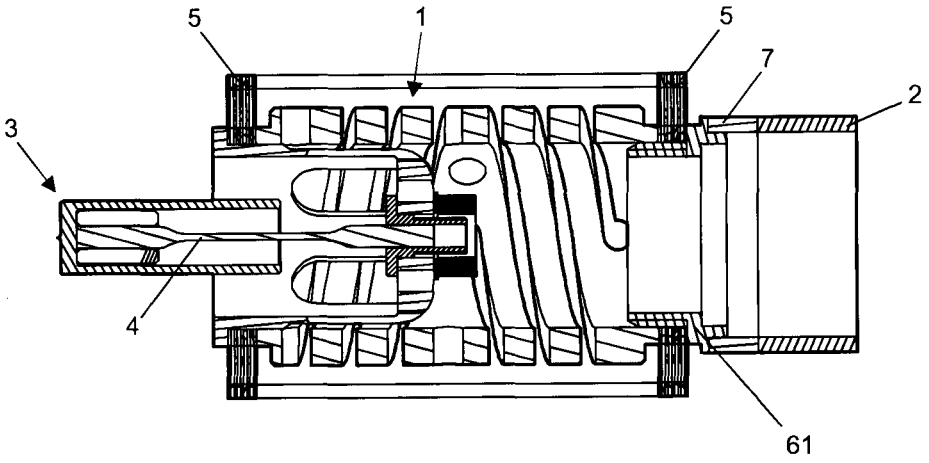
FIG. 1—shows a longitudinal sectional view of a linear compressor which is used in preferred embodiments of the adapter device object of the present invention.

The present invention further comprises a linear compressor comprising a resilient member 1, a magnetic actuator 2 and a reciprocating piston 3 coupled to the resilient member 1 by means of a rod or connecting rod 4, the compressor being capable of operating using flat springs 5, characterized in that it comprises an adapter device defined by at least one support member 6 cooperating with the resilient member 1, said support member 6 comprising a substantially cylindrical part equipped with intermediate perimeter salient portion 61; and at least one fastening ring 7 cooperating with the support member 6 and the magnetic actuator 2, said fastening ring 7 being produced from an electric and non-magnetic insulating material.

Figure 2:
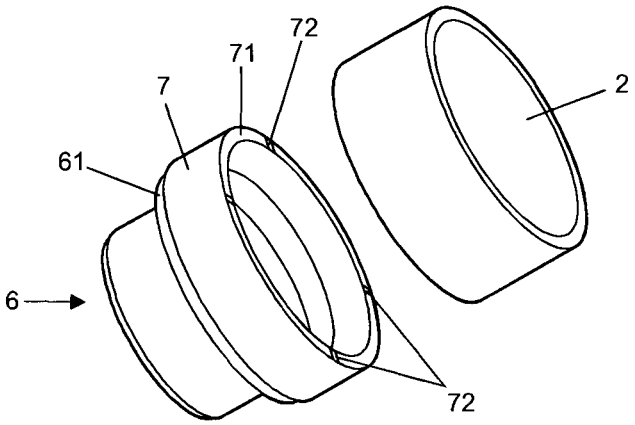
FIG. 2—shows a perspective view of the adapter object of the present invention and the magnetic actuator of the compressor that will couple to the same.
Figure 3:
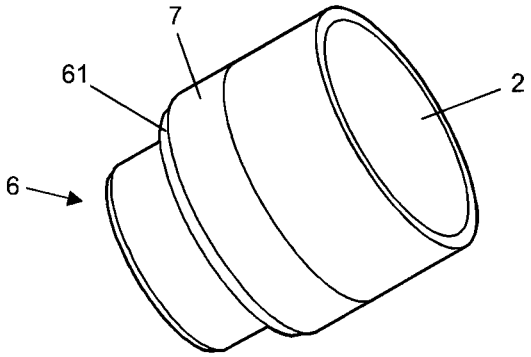
FIG. 3—shows a view in perspective of objects shown in FIG. 2 fully assembled.
Figure 4:
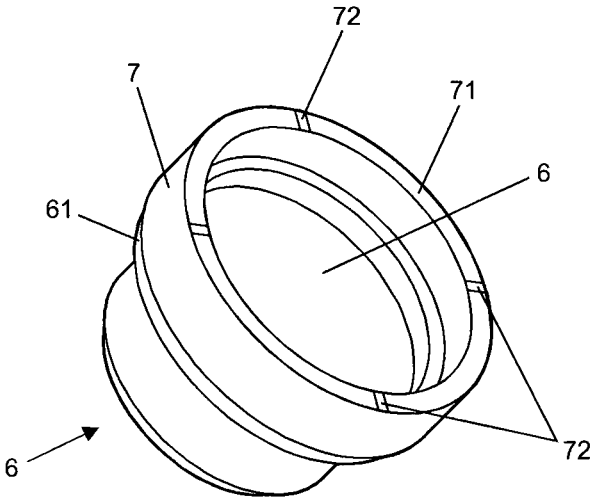
FIG. 4—shows a perspective view of the adapter of the present invention allowing to be noticed, stressed, the splitters designed to aid the homogeneity of the adhesive layer employed to join the adapter and magnetic actuator of the linear compressor.

As can be seen in the drawings listed herein above, the adapter device for a linear compressor built in accordance with a preferred embodiment of the present invention comprises, as illustrated in FIGS. 2 to 4, a support member 6 cooperating with a resilient element 1—that, in the examples, is a resonant spring—and a fastening ring or element 7 which is coupled, by gluing or similar technique, to the magnetic actuator 2 (in this case represented by a magnetic ring having cylindrical conformation) of the equipment motor of the compressor.

FIGS. 1 and 5 allow to notice that the support member 6 is defined by a substantially cylindrical part equipped with a perimeter intermediate salient portion 61, which salient portion subdivides this part into two regions: a proximal (relative to a resilient member 1) which is coupled, along its outer perimeter, to the fastening ring 7 which is effectively attached to the magnetic actuator 2 of the system motor (not shown); and a second region, wherein the resilient member 1 is coupled by interference.

Such a perimeter salient portion 61 presents a step-shaped profile so as to allow the positioning of a flat spring 5—or possibly a leaf flat springs 5—together with the resilient member 1. In this respect, it is clear that the system can operate with or without the presence of flat springs without thereby going beyond the scope of the claimed protection. If the system does not use flat springs, the perimeter salient portion 61 of the support member 6 is in direct contact with the distal end of the resilient member 1.

Also from FIGS. 1, 5.1 and 5.2, it is possible to see that the coupling (fitting) of the resilient member to the adapter device 1 is made by interference, since the proximal region of the support member 6 sets a "male" type part that is inserted into the inner diameter of the resilient member, which acts as a "female" type part for the assembling of the set. Thus, the coupling between the two parts maintains the support member 6 together with the inner perimeter of the distal perimeter region of the resilient member 1, without this assembly requiring the use of adhesives materials, welding or any other fastening means—which is a common embodiment in the present state of the art.

It is important to notice that this form of construction and assembling greatly facilitates any component maintenance and replacement procedures.

In turn, the fastening of the magnetic actuator 2 and the fastening ring 7 is carried out by using any adhesive material applied to the distal edge 71 of the fastening ring, and to ensure that the adhesive layer is kept constant in order to provide adequate fastening of the components, it is provided, as better seen in FIG. 4, splitters 72 (which may be counterbore or salient portions) of approximately 0.1 mm wide on the distal edge 71 of the ring 7.

In short, the assembling of the adapter device for linear compressor object of the present invention involves the following steps:

- coupling, by interference, of the support member 6 to the resilient member 1;
- coupling the fastening ring 7 to the support 6 by means of applying an adhesive material to the perimeter intermediate salient portion 61;
- applying the adhesive on the distal edge 71 of the fastening ring 7; and
- attaching one of the ends of the magnetic actuator 2 on the distal edge 71 of the fastening ring 7.

It is also important to notice that the adapter device object of the present invention can be manufactured in various aesthetic configurations, materials and dimensions, depending on the requirements.

It should be noted that although having been shown preferred constructive forms of the present invention, it is understood that any omissions, substitutions and constructive alterations may be accomplished by a person skilled in the art, without departing from the spirit and scope of the required protection. It is also expressly stated that all combinations of elements that perform the same function in substantially the same way in order to achieve the same results are within the scope of the invention. Substitutions of elements of a described embodiment with others are also fully intended and encompassed.

It should however be understood that the description given above based on figures above relates just to one of possible embodiments for the system of the present invention, the actual scope of the object of the invention being defined in the appended claims.

The invention claimed is:

1. An adapter device for a linear compressor comprising a resilient member, a magnetic actuator and a reciprocating piston coupled to the resilient member by one of a rod and a connecting rod, the linear compressor configured to operate with flat springs, the adapter device comprising:

at least one support member cooperating with the resilient member, the at least one support member comprising a cylindrical part equipped with an intermediate perimeter salient portion, the intermediate perimeter salient portion configuring a stop for a fit coupling of at least one flat spring of the flat springs between the intermediate perimeter salient portion and a distal end of the resilient member;

wherein the intermediate perimeter salient portion of the at least one support member is in direct contact with the distal end of the resilient member;

a male portion of the at least one support member inserted into an inner diameter of a female portion of the resilient member to couple the at least one support member to a distal inner perimeter region of the resilient member;

at least one fastening element cooperating with the at least one support member and the magnetic actuator; and a distal edge of the at least one fastening element having a plurality of splitters and the distal edge of the at least one fastening element being coated with an adhesive element for attaching to the magnetic actuator;

wherein the at least one support member enables interconnection between the magnetic actuator and the resilient member by attaching the magnetic actuator on the distal edge of the at least one fastening element.

2. The device according to claim 1, wherein the at least one fastening element is produced by an electrically insulating and non-magnetic material.

3. The device according to claim 1, wherein the at least one fastening element is produced of a ceramic material.

4. The device according to claim 1, wherein the at least one support member is coupled to the resilient member by an interference coupling.

5. A linear compressor comprising:

a resilient member, a magnetic actuator and a reciprocating piston coupled to the resilient member by one of a rod and a connecting rod, the linear compressor configured to operate with flat springs;

an adapter device comprising at least one support member cooperating with the resilient member, the at least one support member comprising a cylindrical part equipped with intermediate perimeter salient portion, the intermediate perimeter salient portion configuring a stop for a fit coupling of at least one flat spring of the flat springs between the intermediate perimeter salient portion and a distal end of the resilient member;

a male portion of the at least one support member inserted into an inner diameter of a female portion of the resilient member to couple the at least one support member to a distal inner perimeter region of the resilient member;

at least one fastening element cooperating with the at least one support member and the magnetic actuator; and a distal edge of the at least one fastening element having a plurality of splitters and wherein the distal edge of the at least one fastening element is coated with an adhesive element for attaching to the magnetic actuator;

wherein the at least one support member enables interconnection between the magnetic actuator and the resilient member by attaching the magnetic actuator on the distal edge of the at least one fastening element.

* * * * *